US006694576B1

(12) United States Patent
Fujisawa et al.

(10) Patent No.: US 6,694,576 B1
(45) Date of Patent: Feb. 24, 2004

(54) FASTENER STRIP HAVING VENT HOLES

(75) Inventors: Nobuo Fujisawa, Macon, GA (US); Craig Jay Graham, Eastman, GA (US)

(73) Assignee: YKK Corporation of America, Marietta, GA (US)

( * ) Notice: Subject to any disclaimer, the term of this patent is extended or adjusted under 35 U.S.C. 154(b) by 0 days.

(21) Appl. No.: 10/272,159

(22) Filed: Oct. 15, 2002

(51) Int. Cl.[7] ..... A44B 18/00
(52) U.S. Cl. ..... 24/452; 24/442
(58) Field of Search ..... 24/306, 442, 452, 24/450; 428/100

(56) References Cited

U.S. PATENT DOCUMENTS 5,061,540 A 10/1991 Cripps et al.
5,373,712 A * 12/1994 Yamamoto et al. ..... 66/195
5,797,170 A * 8/1998 Akeno ..... 24/452
5,852,855 A 12/1998 Mody et al.
5,997,981 A 12/1999 McCormack et al.
6,363,587 B1 4/2002 Richter et al.
6,463,635 B2 * 10/2002 Murasaki ..... 24/452
2002/0000488 A1 1/2002 Shepard et al.

* cited by examiner

*Primary Examiner*—Robert J. Sandy
(74) *Attorney, Agent, or Firm*—John A. Galbreath

(57) ABSTRACT

The invention is a fastener strip (10) with vent holes (12) through the base layer (15), underneath hooks (11) or other fastening elements, to prevent air from being trapped beneath fastener strip (10) when it is placed on a forming mold (16) in a foam object molding process. Side sealing means (13), end sealing means (14), and magnetic or other holding means may also be incorporated into fastener strip 10.

24 Claims, 9 Drawing Sheets

FASTENER STRIP HAVING VENT HOLES

CROSS-REFERENCES TO RELATED APPLICATIONS

Not applicable.

BACKGROUND

1. Field of the Invention

This invention is in the area of fasteners which are molded into foam objects such as a seat bun, specifically a fastener strip with vent holes through the base layer, underneath the fastening elements, to prevent air from being trapped beneath the fastener strip when it is placed on the mold.

2. Description of the Related Art

In a molding process in which a fastener strip is molded into a foam object such as an automobile seat bun, the fastener strip is placed fastening element side-down onto a surface of the mold cavity. Typically, the fastener strip includes side and end sealing means, so that when liquid resin is poured into the mold, the resin does not penetrate underneath the edges of the fastener strip and foul the fastening elements during the foaming process.

However, a problem arises when air is trapped underneath the fastener strip after it has been placed on the mold. The pressure of liquid resin on the top (face-up) surface of the fastener strip, and the pressure generated by the foaming process itself, can cause any air trapped underneath the fastener strip to be forced out under the edges of the fastener strip—that is, through the interface between the mold surface and the fastener strip edges. The escaping air causes voids to form in the foam seat bun around the area of the fastener strip, and thus prevents the seat bun from fully and properly forming. In addition, when the edges of the fastener strip are lifted up by the escaping trapped air, liquid resin can penetrate under the edges and foul the engaging elements of the fastener strip. It can thus be appreciates that a means to relieve the trapped air and prevent the lifting up of the fastener strip edges would be desirable.

A few fastener strips with apertures are shown in the prior art; however, none of these prior art fastener strips contain the structure necessary to vent the fastener strip in a foam molding process.

U.S. Pat. No. 5,061,540 to Cripps et al. shows base layer openings at the outer side edges of a fastener strip. However, these holes are not for venting air from beneath the fastener strip in the molding process. Instead, they allow foam penetration through the outer side edges, and increase the anchoring strength of the side edges within the foam seat bun. Accordingly, Cripps' holes are not through the portion of the base underneath the fastening elements, as in the invention, and thus cannot achieve the desired venting objective.

U.S. Appl. Pub. #2002/0000488 to Shepard et al. describes a roll of hook fastener strip material with oval cuts, longitudinal slits, and transverse perforations through the base layer, in order to allow a desired length of fastener strip to be torn off the roll. These openings do not have a shape suitable for venting the fastener strip, nor are they spaced properly down the length of the fastener strip to allow for complete and consistent venting, as in the invention. More importantly, Shepard's device lacks the additional structure needed for use in a foam molding process, e.g. holding means to secure the fastener strip to the mold, and side and end sealing means to prevent foam intrusion from fouling the fastener elements during molding. Finally, with respect to the process for making the fastener strip, Shepard's openings are not formed in the extruding step as in the invention. Instead, they are cut into the strip after it is molded, using a cutting die, stamp, or similar tool, thus necessitating an extra step in the production process.

U.S. Pat. No. 6,363,587 to Richter similarly shows a roll of fastener strip composite material with perforations through the base layer. However, the perforations on the roll are not for venting the fastener strip during a molding process, but rather for allowing separate individual composite fastener strip structures to be separated from the roll. Following separation of each individual composite fastener strip structure, the perforations form side edges of the fastener strip element, and no longer define venting perforations through the base layer under the fastening elements, as in the invention. Finally, Richter's device also lacks the additional structure needed for use in a foam molding process, e.g. holding means to secure the fastener strip to the mold, and side and end sealing means to prevent foam intrusion from fouling the fastener elements during molding.

U.S. Pat. No. 5,852,855 to Mody et al. shows a woven hook fastener strip wherein tiny, irregular weave spaces exist between the warp and weft yarns. However, the spaces between the yarns are not suitable for venting the fastener strip in a foam molding application and so not surprisingly, Mody's device lacks the additional structure needed for use in a foam molding process, e.g. holding means to secure the fastener strip to the mold, and side and end sealing means to prevent foam intrusion from fouling the fastener elements during molding. Further, a thermoplastic base layer is present on the back side of Mody's device, to bind the yarns together and provide a measure of stiffness. Mody's thermoplastic base layer does not have through-holes in it, as in the invention.

U.S. Pat. No. 5,997,981 to McCormack et al. describes a fastener strip with a breathable base layer, for use in disposable diapers. The breathable base layer has microscopic openings which allow air to pass through over time, but these openings are much too small to quickly vent a fastener strip in a foam molding process. Further, McCormack's device also lacks the additional structure needed for use in a foam molding process, e.g. holding means to secure the fastener strip to the mold, and side and end sealing means to prevent foam intrusion from fouling the fastener elements during molding.

Thus it can be seen that a fastener suitable for use in a foam object molding process and which has venting means that prevent air from being trapped under the fastener during the molding process, would be a significant advantage over the prior art.

Accordingly, several objects and advantages of the invention are:

The vent holes improve performance by preventing trapped air from lifting up the edges of the fastener strip during the molding process, thus avoiding fouling of the fastening elements and the creation of voids in the foam seat bun.

In fastener strips employing magnetic or other holding means to secure the fastener strip in position on the mold surface, the lifting up of the edges of the fastener strip also tends to weaken the holding force, thereby making it easier for the fastener strip to inadvertently move from the desired position. The vent holes of the invention allows the holding means to remain securely against the mold surface, thus preventing any inadvertent movement.

The invention can be extruded in just one piece at low cost, without the need for additional manufacturing steps.

Further objects and advantages of the invention will become apparent from a consideration of the drawings and ensuing description.

SUMMARY

The invention is a fastener strip with vent holes through the base layer, underneath the fastening elements, to prevent air from being trapped beneath the fastener strip when it is placed on a mold in a foam object molding process.

DETAILED DESCRIPTION OF THE INVENTION

Figure 1:
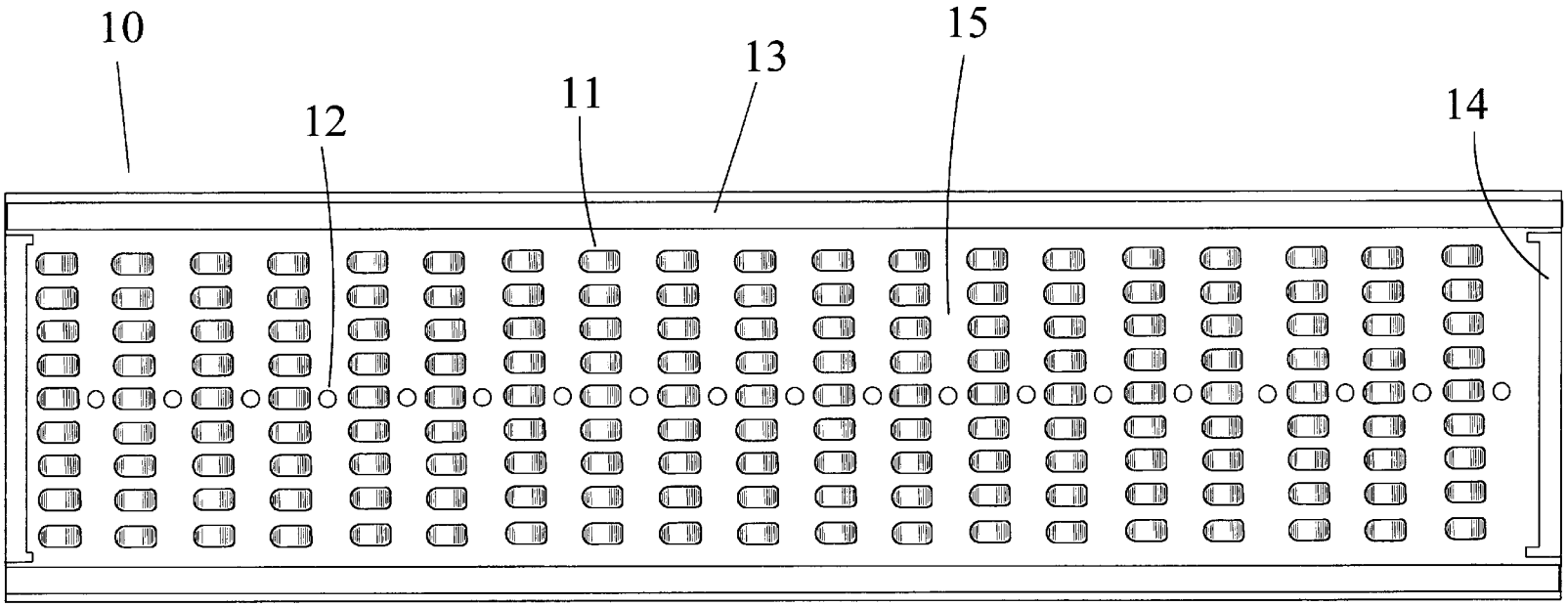
FIG. 1 is a top view of the fastener strip, illustrating the vent holes disposed along the center of the lengthwise dimension thereof.

The following provides a list of the reference characters used in the drawings:

| | |
|---|---|
| 10. | Fastener strip |
| 11. | Hook |
| 12. | Vent hole |
| 13. | Side seal |
| 14. | End seal |
| 15. | Base layer |
| 16. | Forming mold |
| 17. | Extruder |
| 18. | Resin |
| 19. | Hook-forming die wheel |
| 20. | Perforating die wheel |
| 21. | Conical projections |
| 22. | Press plate |
| 23. | Rolling pin press wheel |
| 24. | Stamping pin press plate |

Figure 2:
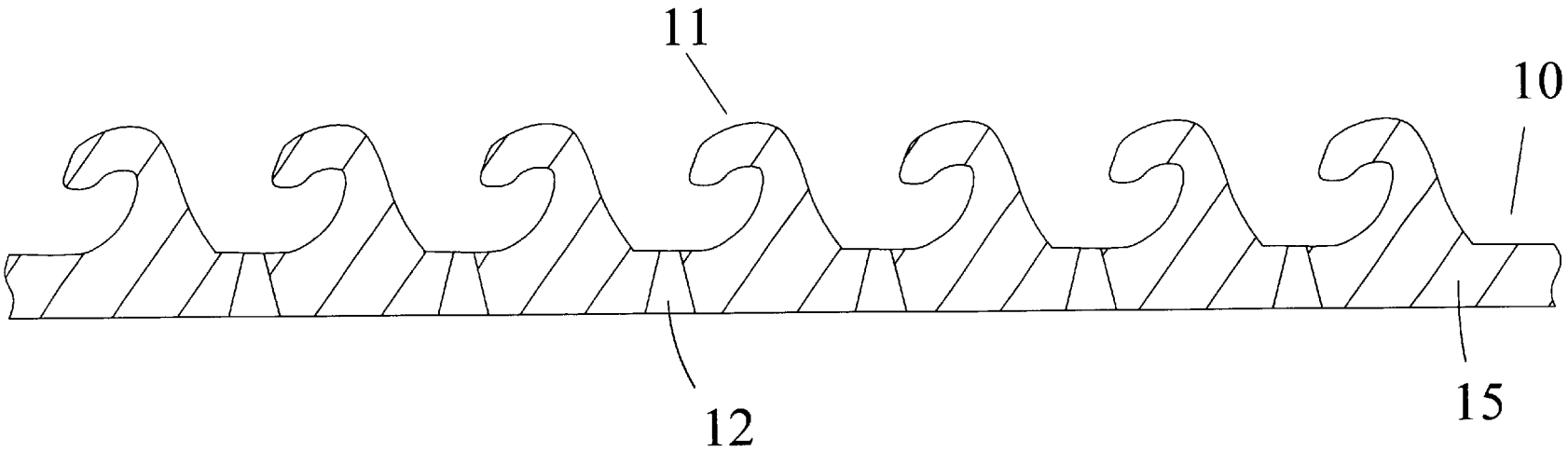
FIG. 2 is a cutaway side view of the fastener strip, illustrating the truncated cone vent holes extending through the base layer underlying the fastening elements.

FIG. 1 is a top view of the invention. Fastener strip 10 comprises a base layer 15 and a plurality of hook fastening elements 11 upstanding therefrom. A plurality of vent holes 12 extend through base layer 15 and are disposed down the center of the lengthwise dimension of fastener strip 10. Side seals 13, comprised of continuous walls also upstanding from base layer 15, are located at each side edge of fastener strip 10. End seals 14, in the form of continuous walls, are located at each end of fastener strip 10. FIG. 2 is a cutaway side view of fastener strip 10, further illustrating the structure thereof and particularly the structure of vent hole 12. Vent hole 12 has a truncated cone shape, with the smaller end of the truncated cone forming an opening in the hook face of fastener strip 10, and the larger end of the truncated cone forming an opening in the non-hook face of fastener strip 10.

Figure 3:
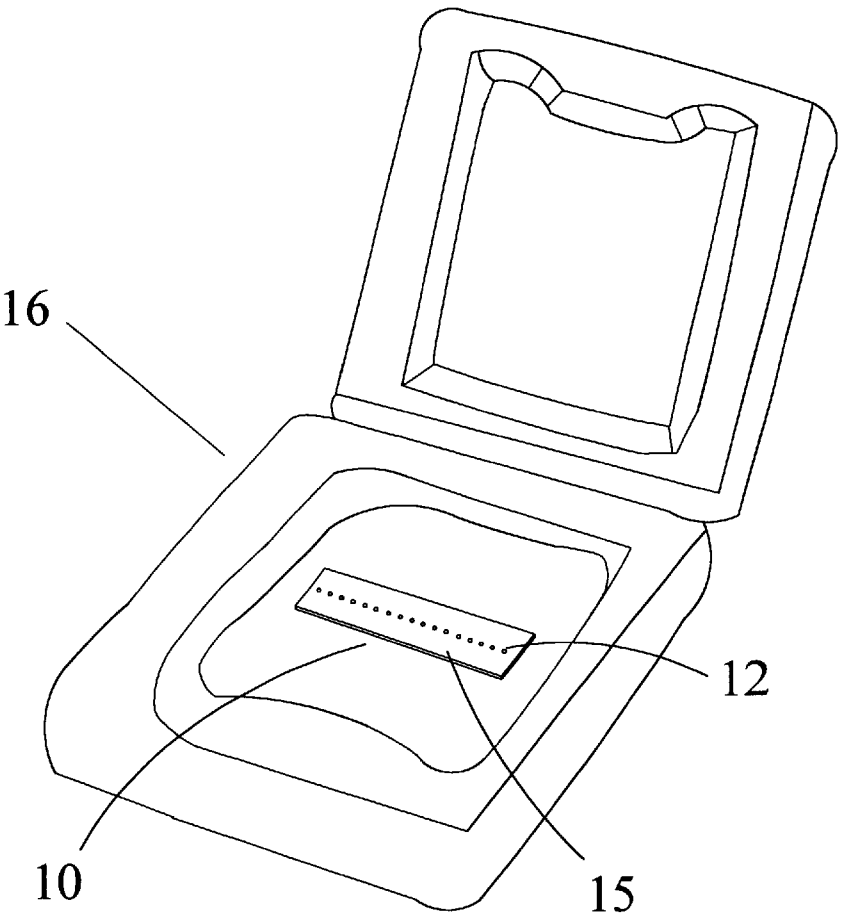
FIG. 3 is a perspective view of the fastener strip, placed fastening element side-down in a foam seat bun forming mold.

FIG. 3 is a perspective view of fastener strip 10 when placed fastening element side-down in a forming mold 16, before the pouring of liquid resin into forming mold 16 to form the foam seat bun or other object. It can be appreciated from this view that when liquid resin is poured into forming mold 16 and the foam-molding process begins, any air from underneath fastener strip easily escapes through the vent holes in the base layer, rather than being forced out the sealed sides or ends of fastener strip 10. In contrast, the more viscous liquid resin cannot penetrate to any deleterious extent through vent holes 12 into the area of hooks 11.

Figure 4:
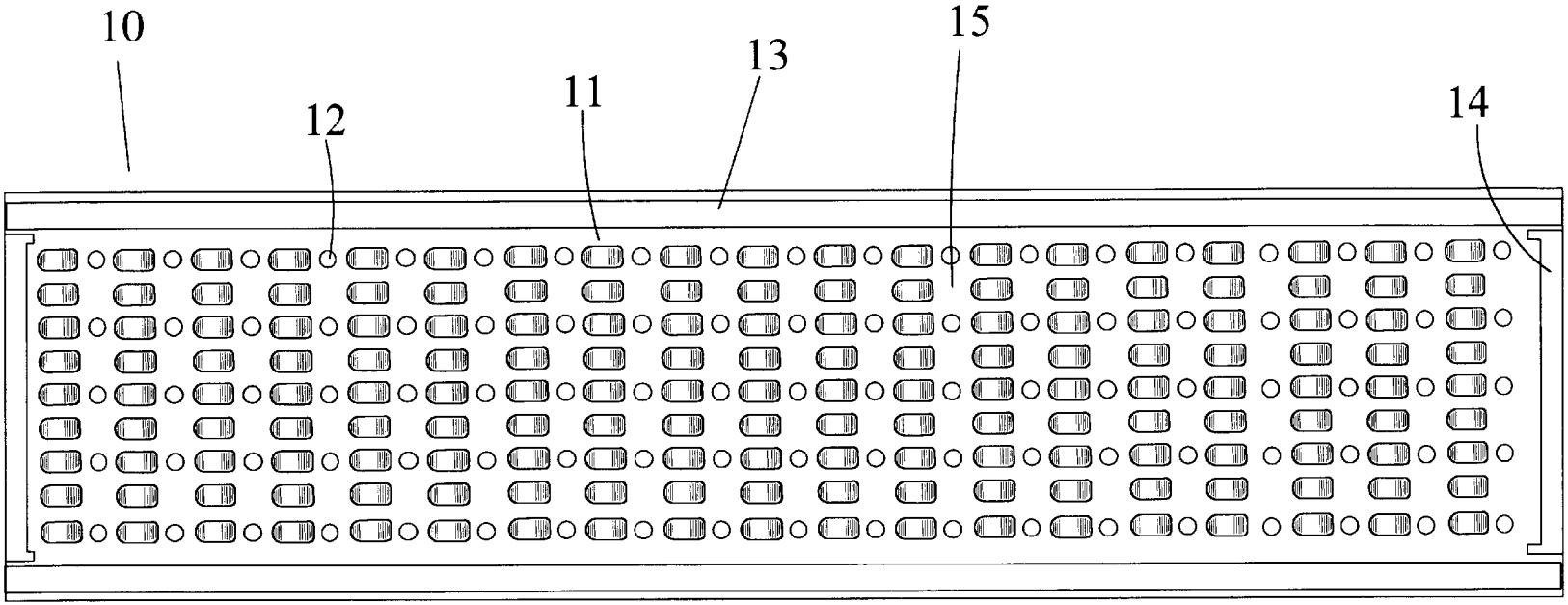
FIG. 4 is a top view of an alternative embodiment, wherein vent holes are disposed generally across the face of the fastener strip.

FIG. 4 is a top view of an alternative embodiment, wherein vent holes 12 are distributed generally across the face of fastener strip 10, rather than down the center of the lengthwise dimension as in the main embodiment. Due to the greater number of vent holes 12 in this embodiment, vent holes 12 can be made smaller yet still adequately relieve air trapped underneath fastener strip 10.

Figure 5:
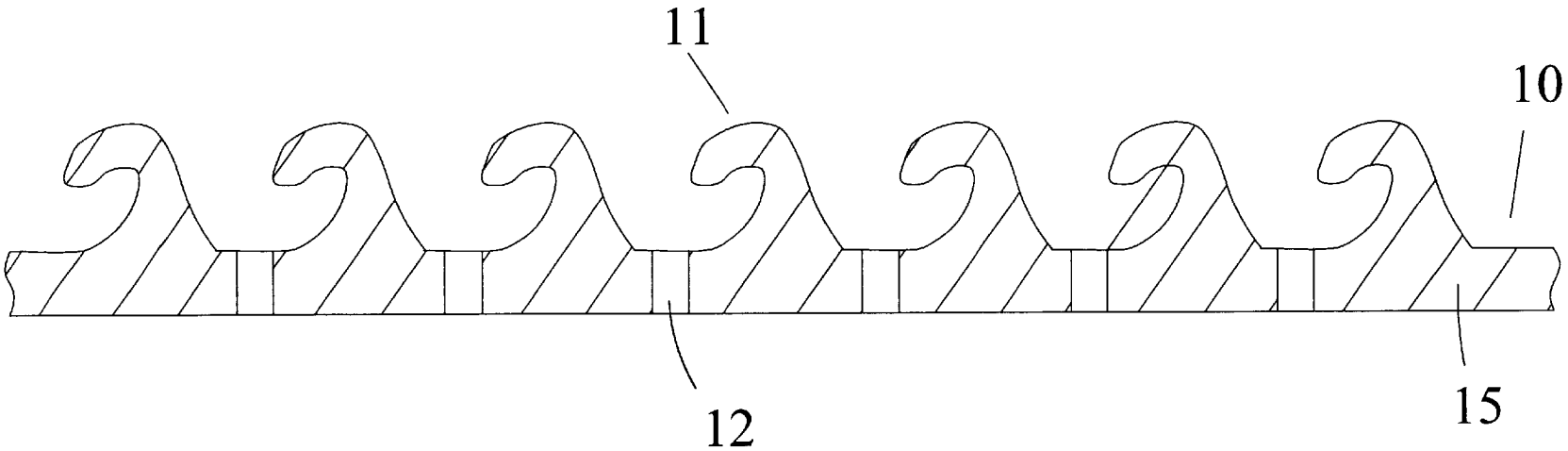
FIG. 5 is a cutaway side view of an alternative embodiment, wherein the vent holes have a cylindrical shape, rather than a truncated cone shape.

FIG. 5 is a cutaway side view of an alternative embodiment, wherein vent holes 12 have a cylindrical shape, rather than a truncated cone shape as in the main embodiment.

Figure 6:
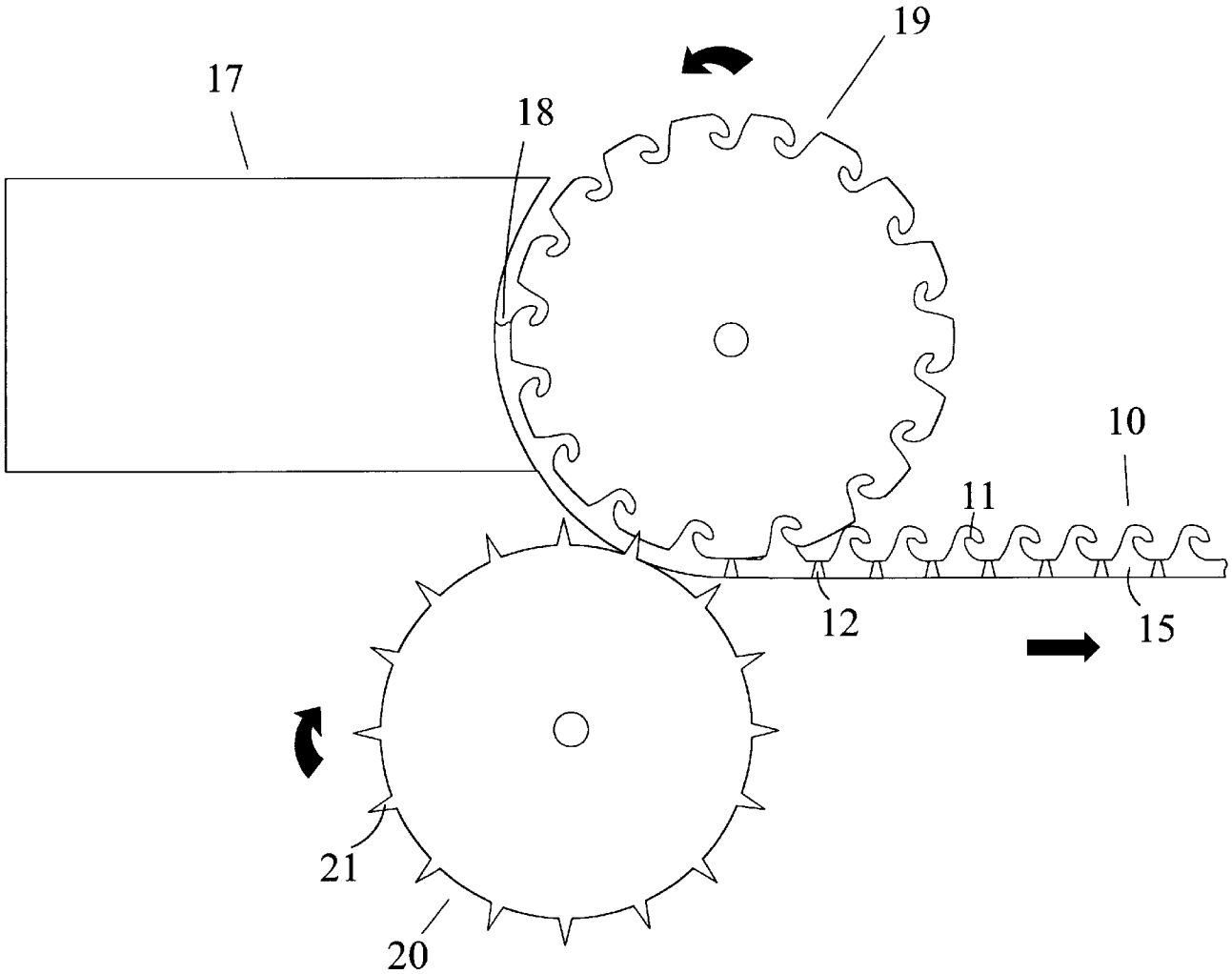
FIG. 6 is a cutaway side view of an extrusion process for manufacturing the fastener strip, comprising an extruder, a hook-forming die wheel, and a perforating die wheel which forms the vent holes.

Turning now to processes by which the vented fastener strip of the invention is manufactured, FIG. 6 is a cutaway side view of an extrusion process for manufacturing fastener strip 10, comprising an extruder 17, a hook-forming die wheel 19, and a perforating die wheel 20 which forms the vent holes. (Please note that the section lines have been omitted from FIG. 6, in order to most clearly illustrate the vent hole forming process.) Extruder 17 forces molten resin 18 through an opening in its front face proximate to hook-forming die wheel 19. Perforating die wheel 20 has a plurality of conical projections 21 located around its circumference, and is positioned proximate to hook-forming die wheel 19, such that fastener strip 10 passes between hook-forming die wheel 19 and perforating die wheel 20. As hook-forming die wheel 19 rotates, fastener strip 10 is pulled from its lower periphery, and simultaneously conical projections 21 on perforating die wheel 20, which also rotates, form a series of spaced vent holes 12 through base layer 15 of fastener strip 10.

Figure 7:
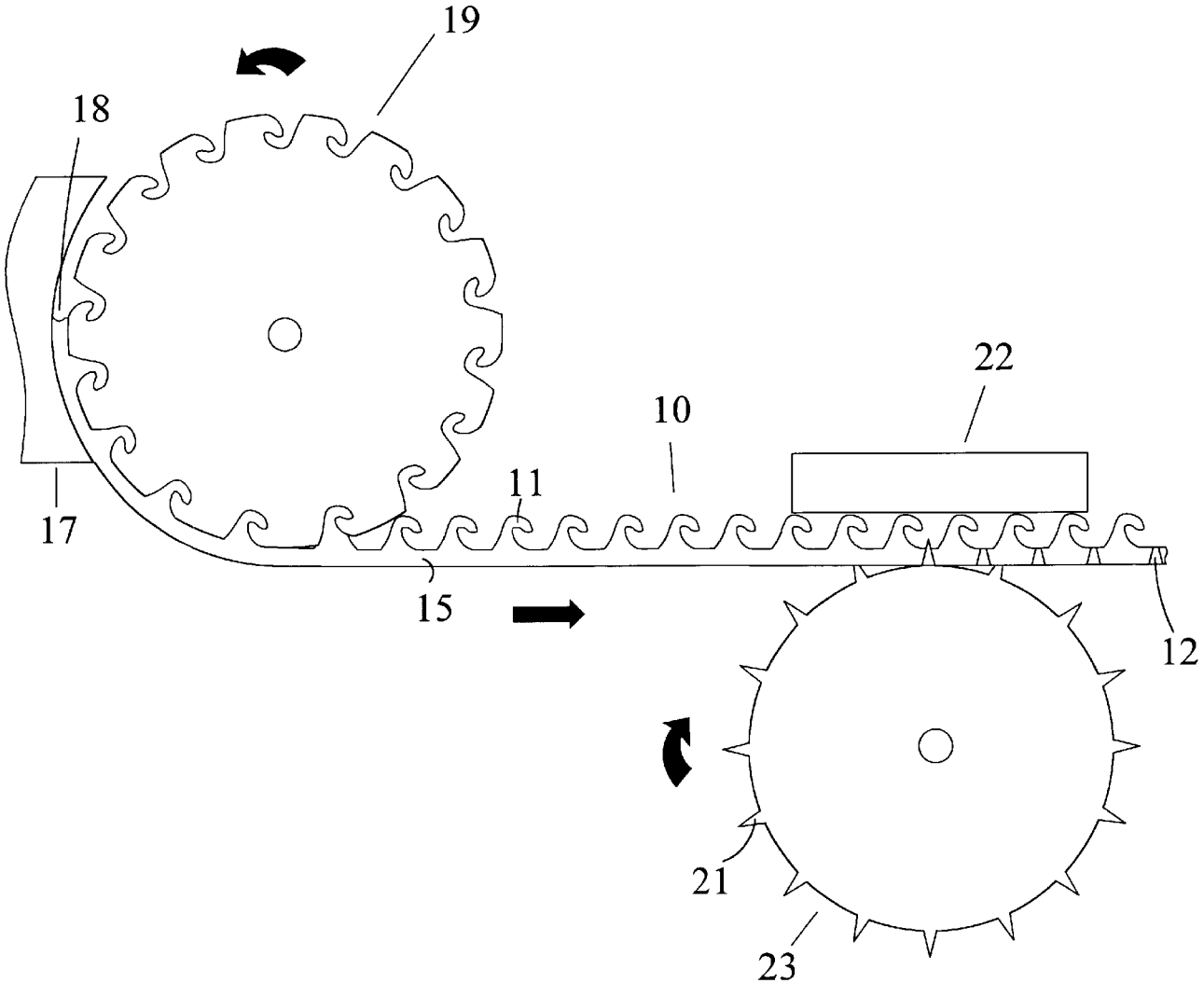
FIG. 7 is a cutaway side view of an alternative process, wherein a rolling pin press wheel and a flat press plate form the vent holes after the hook and base layers are extruded.

FIG. 7 is a cutaway side view of an alternative process, wherein a rolling pin press wheel 23 and a flat press plate 22 form vent holes 12 after hooks 11 and base layer 15 are extruded. (Please note that the section lines have been omitted from FIG. 7, in order to most clearly illustrate the vent hole forming process.) As shown in FIG. 7, after fastener strip 10 has been extruded and pulled from hook-forming die wheel 19, fastener strip 10 is pressed between rolling pin press wheel 23, which rotates, and flat press plate 22, which is stationary. Vent holes 12 are thus formed through base layer 15 in fastener strip 10.

Figure 8:
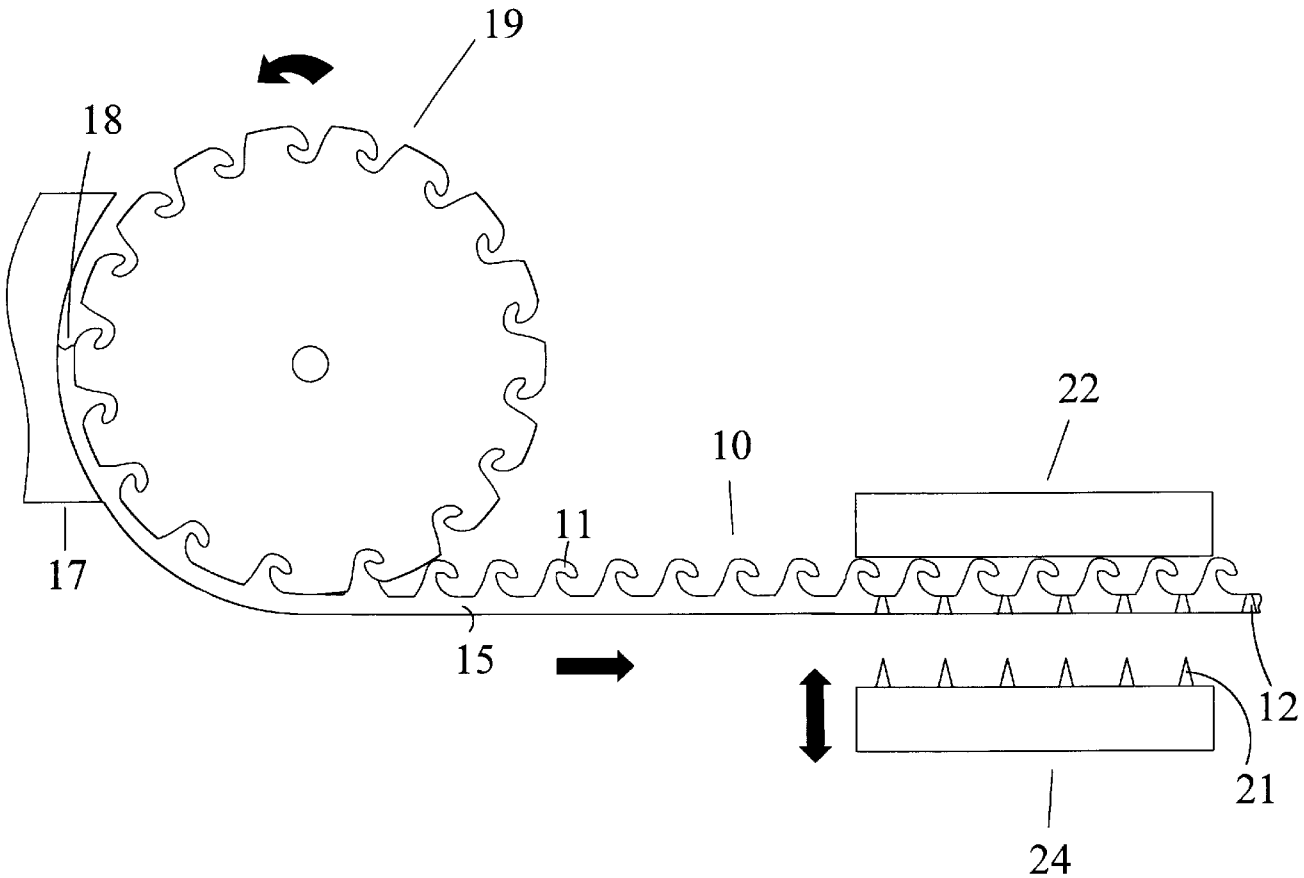
FIG. 8 is a cutaway side view of an alternative process, wherein a stamping pin press plate and a flat press plate form the vent holes after the hook and base layers are extruded.

FIG. 8 is a cutaway side view of an alternative process, wherein a stamping pin press plate 24 and a flat press plate 22 form vent holes 12 after hooks 11 and base layer 15 are extruded. (Please note that the section lines have been omitted from FIG. 8, in order to most clearly illustrate the vent hole forming process.) As shown in FIG. 8, after fastener strip 10 has been extruded and pulled from hook-forming die wheel 19, fastener strip 10 is pressed between stamping pin press plate 24, which reciprocates up and down, and flat press plate 22, which is stationary. Vent holes 12 are thus formed through base layer 15 in fastener strip 10.

Figure 9:
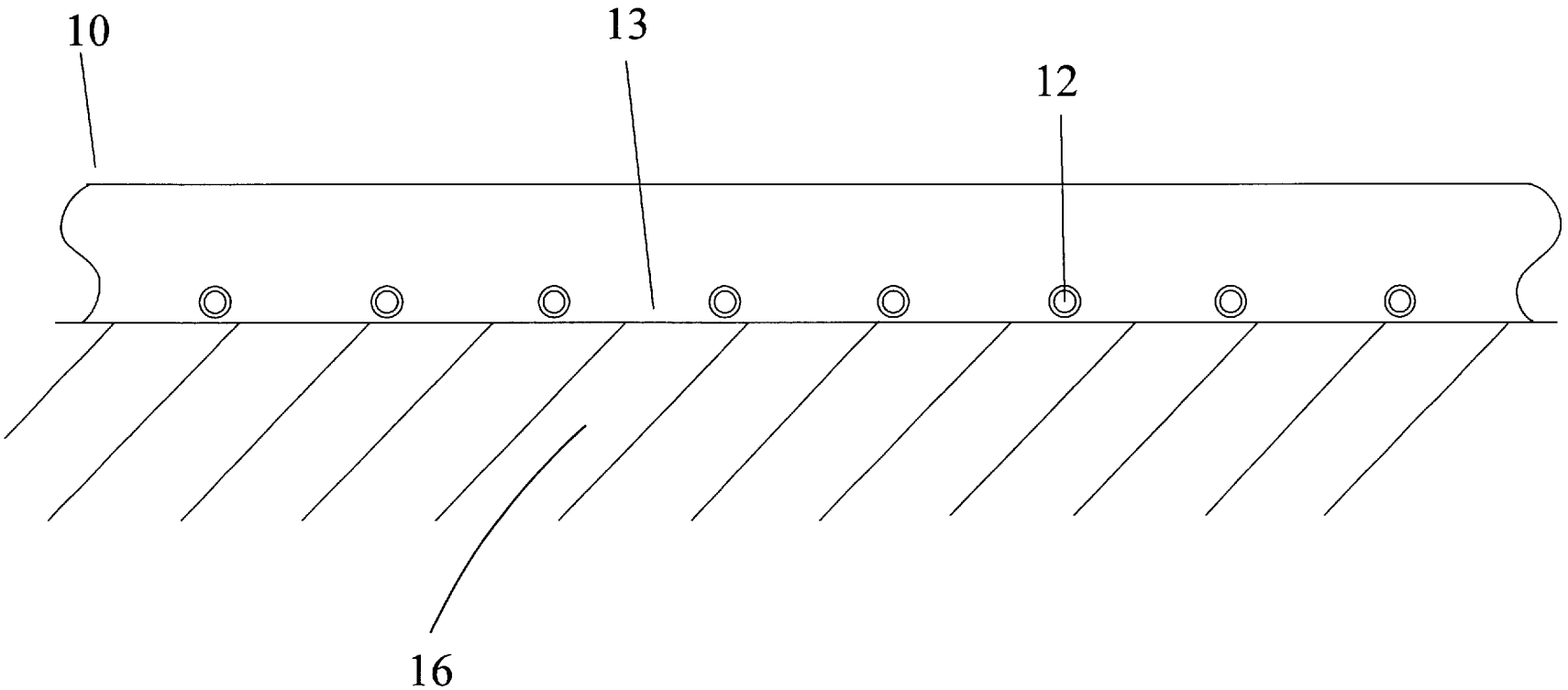
FIG. 9 is a side view with the forming mold cut away, illustrating the alternative embodiment wherein vent holes are located through the side seal of the fastener strip.

FIG. 9 is a side view of an alternative embodiment, wherein vent holes 12 are located through the side seal 13 of fastener strip 10. Vent holes 12 have a truncated cone shape; however, they may also be cylindrical or have any other suitable shape. It can be appreciated that FIG. 9 can also represent the situation wherein vent holes 12 are located through the end seal 14 of fastener strip 10. This alternative embodiment can be manufactured using processes very similar to those illustrated in FIGS. 6–8, except that perforating die wheel 20, rolling pin press wheel 23, and stamping pin press plate 24 are positioned in a plane perpendicular to hook-forming die wheel 19, rather than in the same plane as in the main embodiment. In this way, vent holes 12 are formed through side seal 13 rather than through base layer 15.

CONCLUSIONS, RAMIFICATIONS, AND SCOPE

Thus the reader will see that this invention provides a very effective way of preventing air from being trapped beneath a fastener strip.

While the above descriptions contain many specificities, these shall not be construed as limitations on the scope of the invention, but rather as exemplifications of embodiments thereof. Many other variations are possible. Examples of just a few of the possible variations follow:

The slope of the sides of the truncated cone-shaped vent holes can be different, yielding of course different ratios of small opening diameter to large opening diameter. It can be appreciated that the truncated cone shape of the vent holes permits a certain amount of foaming liquid resin to penetrate the larger end of the vent holes during the foam molding process, yet not penetrate the smaller hook face end of the vent holes. Thus, the vent holes perform an anchoring function in addition to their venting function, and help to attach the fastener strip more securely to the object being foam-molded.

The shape and size of the vent holes can be different than that shown in the main and alternative embodiments. As just a few examples, the vent holes can be ellipsoid, square, or slit-shaped. The number of vent holes can be different than that shown in the main and alternative embodiments, and the hole pattern across the face of the fastener strip or along the side or end seal can also be different. Further, the shape of the vent holes can be inconsistent with each other—i.e., a mixture or combination of vent holes sizes and shapes can be employed on a given fastener strip to achieve the desired venting characteristics. In summary, it is only necessary that the vent holes perform the function of adequately relieving trapped air without causing voids in the object being foam-molded, and without permitting undue intrusion of liquid resin into the fastening element area.

The fastening elements can be different—different types of hooks can be employed, and loop material can also be used instead of hooks.

Side and/or end sealing means that are different from that shown can be employed, including but not limited to staggered blocks, foam strips, strips of loop material, or any other suitable side and/or end sealing means. Additionally, magnetic or other holding means can be incorporated into the fastener strip, to hold the fastener strip in position on the mold during the molding process.

The fastener strip can be of any shape, including circular or square-shaped, and not just the rectangular strip shape shown in the various embodiments above. The basic concept of the invention—vent holes through the base layer to prevent air from being trapped beneath the fastener strip—is applicable to fastener strips having many different shapes.

The vented fastener strip of the invention can be used on molds having recesses into which the fastener strip fits, or alternatively on molds having no such recesses.

The fastener strip can be made by processes different than the extrusion processes shown in FIGS. 6–8. As just one example, injection molding can be used.

When the vented fastener strip of the invention is used in a foam-molding application, the molded object can be a foam seat bun as described herein, or it can be any other foam-molded object. Further, the vented fastener strip can be used for applications other than the foam molding application described herein. A hook fastener strip with vent holes in the base layer—that is, a base layer that allows the passage of air, fluid, particles, or other substances through it—would have many additional applications, including but not limited to medical, recreational, and industrial applications.

Accordingly, the scope of the invention should be determined not by the embodiments illustrated, but by the appended claims and their legal equivalents.

What is claimed is:

1. A fastening device, comprising:

(a) a base layer, and (b) at least one fastening element located on said base layer, and (c) means for venting air from beneath said fastening device when said fastening device is placed on a forming mold, whereby molding said fastening device into an object using said forming mold is facilitated.

2. The fastening device of claim 1, wherein said venting means comprise at least one conical hole through said base layer.

3. The fastening device of claim 2, wherein a plurality of conical holes are disposed down the center of the lengthwise dimension of said base layer.

4. The fastening device of claim 2, wherein a plurality of conical holes are distributed generally across a face of said base layer.

5. The fastening device of claim 1, wherein a plurality of hook fastening elements are located on said base layer.

6. The fastening device of claim 1, wherein said fastening device additionally comprises sealing means located on a side edge of said base layer.

7. The fastening device of claim 6, wherein said venting means comprise at least one hole through said sealing means.

8. The fastening device of claim 1, wherein said fastening device additionally comprises sealing means located on an end of said base layer.

9. The fastening device of claim 8, wherein said venting means comprise at least one hole through said sealing means.

10. The fastening device of claim 1, wherein said fastening device is formed of extruded thermoplastic.

11. A fastening device, comprising:

(a) a base layer, and (b) an area of fastening elements located on said base layer, and (c) at least one conical vent hole extending through said base layer proximate to said area of fastening elements, whereby said vent hole relieves air trapped beneath said fastening device when said fastening device is placed on a forming mold.

12. The fastening device of claim 11, wherein a plurality of conical vent holes are disposed down the center of the lengthwise dimension of said base layer.

13. The fastening device of claim 11, wherein a plurality of conical vent holes are distributed generally across a face of said base layer.

14. The fastening device of claim 11, wherein said fastening elements are hooks.

15. The fastening device of claim 11, wherein said fastening device additionally comprises sealing means located on a side edge of said base layer.

16. The fastening device of claim 11, wherein said fastening device additionally comprises sealing means located on an end of said base layer.

17. The fastening device of claim 11, wherein said fastening device is formed of extruded thermoplastic.

18. A fastening device, comprising:

(a) a base layer, and (b) a plurality of fastening elements located on said base layer, and (c) sealing means located on said base layer, and (d) at least one hole extending through said base layer proximate to said fastening elements, said base layer being substantially flat between said hole and said fastening elements.

19. The fastening device of claim 18, wherein a plurality of conical vent holes are disposed down the center of the lengthwise dimension of said base layer.

20. The fastening device of claim 18, wherein a plurality of conical vent holes are distributed generally across a face of said base layer.

21. The fastening device of claim 18, wherein said fastening elements are hooks.

22. The fastening device of claim 16, wherein said fastening device is formed of extruded thermoplastic.

23. A fastening device, comprising:

(a) a base layer, and (b) at least one fastening element located on said base layer, and (c) at least one conical hole extending through said base layer.

24. A fastening device, comprising:

(a) a base layer, and (b) at least one hook fastening element located on said base layer, and (c) at least one conical vent hole extending through said base layer proximate to said fastening element, whereby said vent hole allows air to pass through said base layer of said fastening device.

* * * * *